United States Patent [19]

Krausz

[11] Patent Number: 4,603,854

[45] Date of Patent: Aug. 5, 1986

[54] TRUNK-TWIST EXERCISE DEVICE

[76] Inventor: Frank Krausz, 405 Commonwealth Ave., Boston, Mass. 02215

[21] Appl. No.: 618,187

[22] Filed: Jun. 7, 1984

[51] Int. Cl.[4] ..... A63B 21/00

[52] U.S. Cl. ..... 272/116

[58] Field of Search ..... 272/71, 93, 116, 128, 272/120, 137; 273/67 B; 440/101, 102

[56] References Cited

U.S. PATENT DOCUMENTS

| | | | |
|---|---|---|---|
| 3,052,897 | 9/1962 | Martin . | |
| 3,889,308 | 6/1975 | Persson . | |
| 4,203,599 | 5/1980 | Starrett | 273/84 R |
| 4,257,591 | 3/1981 | Evans | 272/93 X |

FOREIGN PATENT DOCUMENTS

| | | | |
|---|---|---|---|
| 2007063 | 8/1971 | Fed. Rep. of Germany | 440/101 |

*Primary Examiner*—Robert A. Hafer
*Assistant Examiner*—Kathleen D'Arrigo
*Attorney, Agent, or Firm*—Ladas & Parry

[57] ABSTRACT

A trunk-twist exercise device comprises a shaft, preferably adjustable in length, having a blade mounted at either end thereof and having handles closer to the end of the shaft than its mid point. The shaft may be straight in which case the handles are normally perpendicular to the shaft or it may be yoke-shaped in which case the handles may be co-axial with the shaft. The angle at which the blades are set is also preferably adjustable.

7 Claims, 10 Drawing Figures

TRUNK-TWIST EXERCISE DEVICE

BACKGROUND OF THE INVENTION

1. Field of the Invention

The present invention relates to an exercise device.

2. Description of the Prior Art

Exercise devices in which the exerciser works against air or water resistance are known. For example U.S. Pat. No. 1,279,633 (issued to Irving O. Allen on Sept. 24, 1918) describes an exercise machine which permits the work done to the exerciser using a variety of exercise devices to be increased by application of air resistance, U.S. Pat. No. 3,517,930 (issued to Allen I. Jacobson on June 30, 1970) describes a harness device which enables swimmers to increase the water resistance to which they are subject during swimming.

Trunk-twist exersis are currently carried out in the gymnasium using a broomstick or simular piece of wood. There is a so-called "Nautilus" machine which enables one to carry out such exercises with varying resistance. It is, however, a complicated and expensive piece of apparatus.

SUMMARY OF THE INVENTION

I have now devised a simple piece of equipment to increase the work done in basic trunk-twist exercises by use of air resistance. Said piece of equipment comprises a shaft having blades mounted at either end thereof and two handles attached to said shaft and preferably projecting therefrom at right angles to the axis of the shaft, each handle being closer to the end of the shaft than its mid point.

Optionally the shaft is of adjustable length. Typically shafts are, or are adjustible to, lengths of from 4 feet to 8 feet, preferably 5 feet to 7 feet, optimally 5 feet 6 inches to 6 feet 6 inches.

The handles are positioned on the shaft so that they can be gripped to the outstretched arms of the exerciser. Typically the distance between clenched fists of outstretched arms of a six foot male is about 5 feet. Typically the distance between the clenched fists of outstretched arms of a five foot female is about 4 feet 6 inches. Children who may use this equipment have shorter arm spans, possibly even as short as 3 feet. The handles of the present apparatus should therefore be positioned so that they can be grasped by such persons. When the equipment has a shaft of adjustable length the handles should be mounted on it so that the distance between them can be adjusted between 4 feet 3 inches and 5 feet 6 inches for an adult model of the equipment. For children's version of the equipment the distance between the handles should be adjustable to from 3 feet to 4 feet six inches.

The blades may be either permanently mounted on the shaft or detachable. If they are detachable it is possible to supply the equipment with a variety of different size blades so that the exerciser can choose the amount of air resistance against which he wishes exerciser. An alternative way of varying the degree of air resistance is to mount the blades in such a way that their plane is rotatable relative to the handles on the shaft. For maximum resistance the plane of the blades will be parallel to the axis of the handles when these are at right angles to the shaft. For lesser degrees of resistance, however, the plane of the blades may be rotated up to a maximum of 90° to the axis of the handle. Since, at this angle air resistance would be minimal it is unlikely that such a position would in fact be used and positionings of the plane of blade at angles of from 0° to 45° to the axis of the handle are most preferable. Normally the mounting of both blades will be coplanar.

When the length of the shaft is adjustable, any suitable means for adjustment must be used. For example the shaft may be comprised of three pieces. In this case the two pieces, intended as the outer two pieces will bear or be adapted to bear the blades. The remaining piece is mounted so as to be readily separable from the outer pieces so that it may be replaced by a piece of a different length, thereby permitting adjustment of the length of the shaft as a whole. When this embodiment is adapted the device may be supplied with a variety of "center pieces" of different length. The ends of each of the pieces of the shaft which have to interact may be shaped and sized so as to fit snugly into each other. As an alternative means for providing a shaft of adjustable length one half shaft may be a slightly smaller diameter than the other so that it may fit snugly inside the other and the length of the shaft be adjusted by simply moving the two half shafts relative to each other, maintenance of the correct position during use being effected simply by friction. Alternatively the adjustment means can provide for locking the half shafts in position during use. For example one can provide holes at the non-blade end of each of the half shafts as previously described and provide studs or pins to pass through said holes once the holes have been aligned. A further possible alternative is to provide pins on one half shaft and a slot in the other half shaft, said groove being provided with indents with which the pins of the other half shaft may be engaged by rotation of the two half shafts relative to each other.

Although the shaft will normally be straight, it may also be supplied a yoke-shaped with a curved portion to accommodate the shoulders the shaft having a straight portion either side thereof. In this case the handles may be more conveniently mounted co-axia1 with the shaft rather than at right angles to it. Furthermore in this case if the shaft is of adjustable length it may be desirable to provide for two separate points at which adjustment can be made, one in each of the straight portions of the shaft. The positions of the blades can be varied in this embodiment also, maximum air resistance being met when the blades are perpendicular to the plane of the yoke.

The shaft may be made of any suitable light weight rigid material. Normally it will be in the form of a hollow light weight of metal (for example aluminum) or plastics material such as polyethylene or polypropylene or rigid polyvinyl chloride.

The blades may be any convenient shape for example rectangular or circular. For ease of affixing them to the shaft, however, they are conveniently "paddle shaped". The blades are made of a rigid light weight material such as a plastic material, for example polyethylene, polypropylene or rigid polyvinyl chloride. Typically the blades are planar, although it is possible also to use curved blades.

BRIEF DESCRIPTION OF THE DRAWINGS

Specific embodiments of the invention will now be described with reference to the accompanying drawings.

For the embodiment shown in FIG. 1 the device comprises a shaft 1 having blades 2,3 mounted at each end and handles 4,5 mounted on the shaft perpendicular thereto at a distance of about 6 inches from the ends of the shaft. The central portion of the shaft is not shown. If the shaft is a single fixed length shaft its total length is about 6 feet. Alternatively the shaft may be of adjustable length and the central portion be in the form shown in more detail in FIGS. 5–8. The blades 2,3 are generally "paddle-shaped" and typically have a base length of about 18 inches and a distance from the base to the apex of the paddle of about 12 inches. Although in some embodiments the blades may be fabricated integrally with the shaft if both of these are made of plastic material, in the embodiment shown in FIG. 1 the blades are separate pieces which can be mounted on the shaft. Each blade piece has a tubular extension 6,7 into which fits into the end of the shaft as is shown in FIGS. 4A and 4B which show in FIG. 4B a cross section of the corresponding piece of the shaft. As shown in FIG. 4A the shaft wall has grooves 6′,7′,8′ cut into it. These grooves can accommodate a projection 9 on an essentially tubular extension 7 of the blade 3. Thus by choosing the groove into which projection 9 is inserted one can choose the angle which the blade 3 makes relative to the handle 5. Typically projection 9 extends out from the outer surface of tubular extension 7 by $\frac{1}{8}$ to $\frac{1}{4}$ inch.

FIG. 3 shows a cross section view from another position wherein the place of the blade is disposed at an angle to the axis of the handle.

As mentioned above the shaft may be of fixed length but it is often more convenient for it to be of adjustable length. FIGS. 5 and 6 illustrate one method of doing this. FIG. 5 is in partial view of the two half shafts 11,12. Each half shaft has holes 13 bored therethrough at opposite ends of a diameter of the half shaft. To fix the shaft at a given length holes on each of the two half shafts are aligned and a stud 14 passed therethrough and a cap 15 affixed to the opposite end thereof. The stud 14 and cap 15 may be of any suitable material. For example a rigid plastic material. The cap 15 should be of such resiliency that it can form a snap fit over the end of the stud which projects beyond the walls of the shaft.

Figure 1:
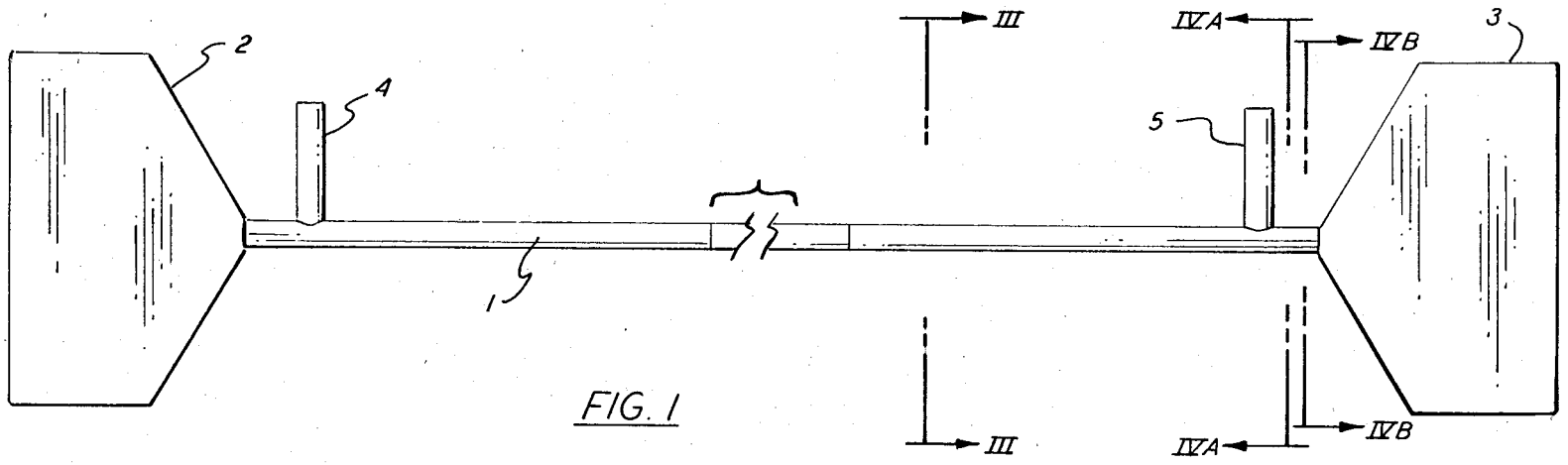
FIG. 1 is a perspective view of a device according to the invention.
Figure 3:
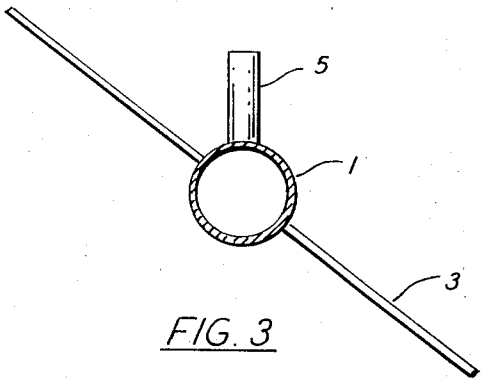
FIG. 3 shows the possible rotation of the blade relative to the handle in the device of FIG. 1.
Figure 2:
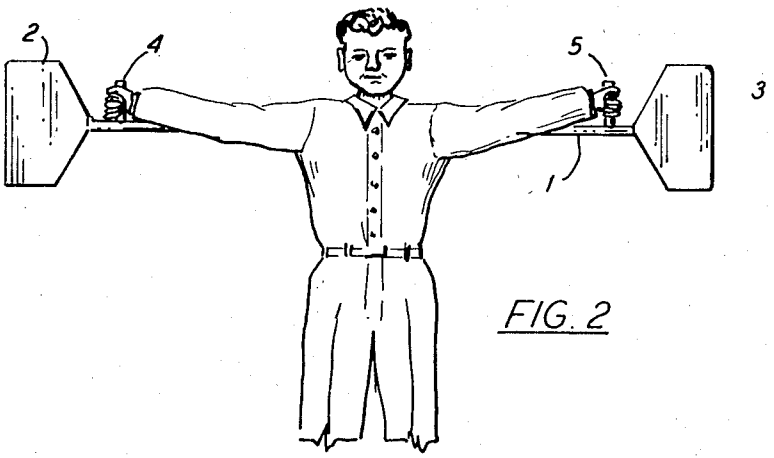
FIG. 2 shows the use of a simple device according to this invention.
Figure 6:
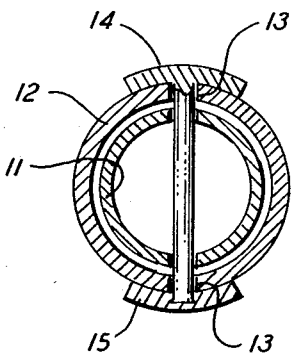
FIGS. 5 and 6 show a partial view of part of a shaft having one means for adjusting the length for a shaft of adjustable lengths.
Figure 5:
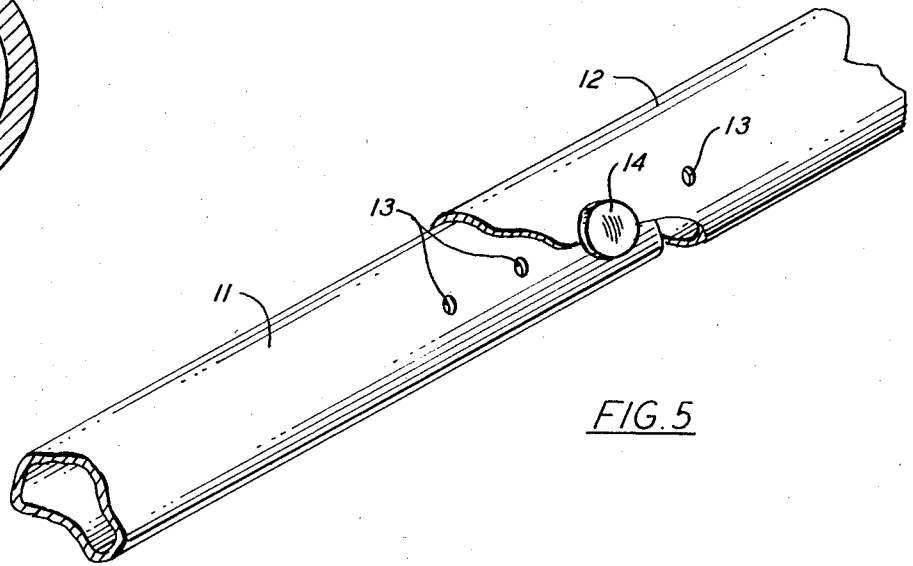
Figure 4A:
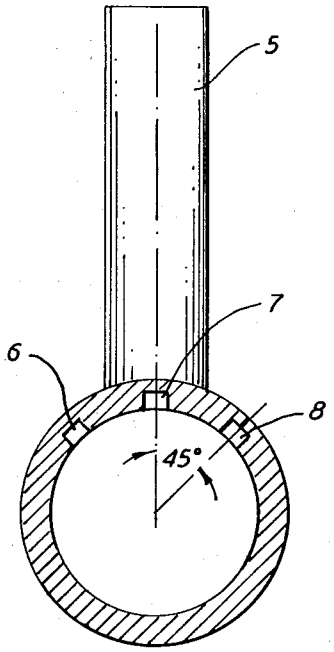
FIGS. 4A and 4B show fittings for the blade and the shaft to enable the blade to be mounted in particular positions relative to the handle.
Figure 4B:
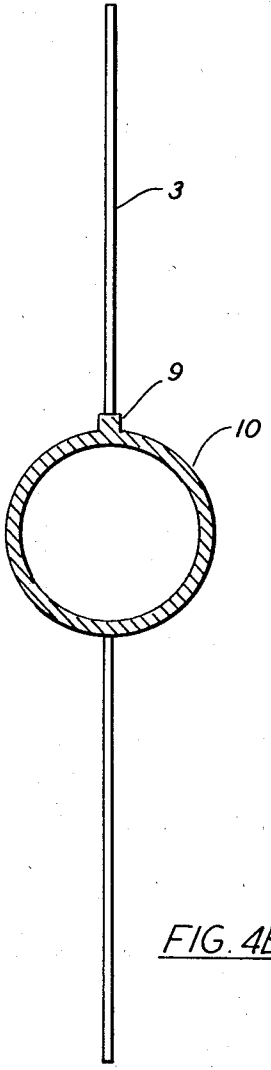
Figure 8:
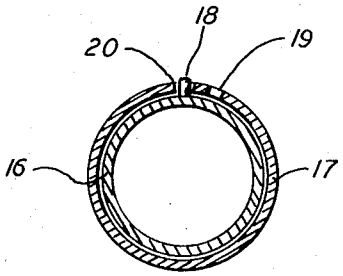
FIGS. 7 and 8 show a partial view of a shaft incorporating an alternative means for adjusting the lengths of the shaft.
Figure 7:
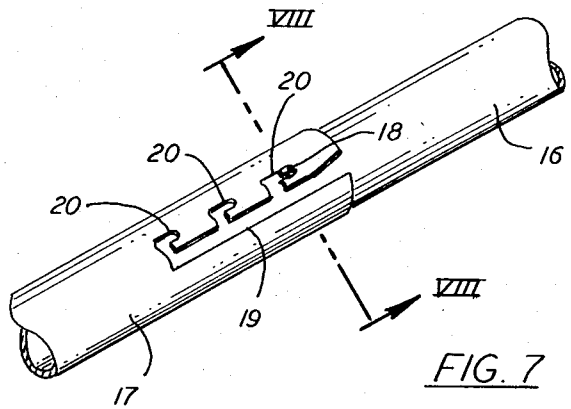
Figure 9:
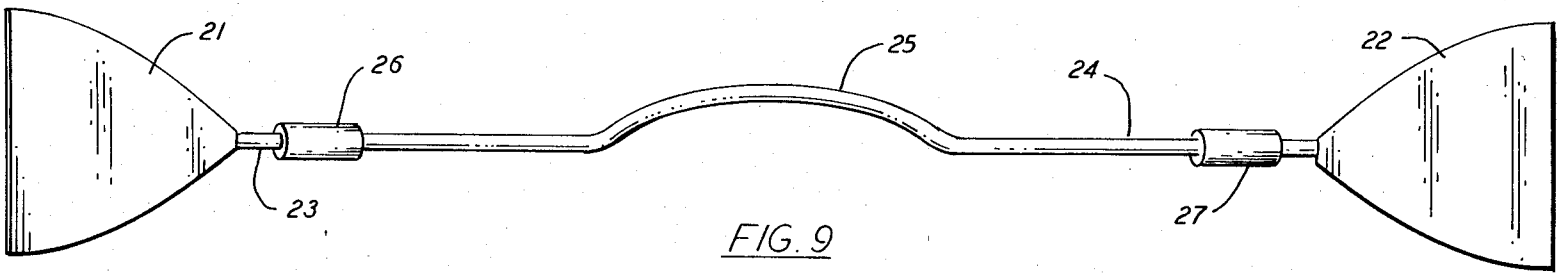
FIG. 9 shows an alternative embodiment of the invention wherein the shaft is yoke-shaped.

An alternative means for adjusting the length of the shaft is shown in FIGS. 7 and 8. These again show partial views of two half shafts 16,17. In this case, however, one half shaft 16 has a projection 18 thereon. The other half shaft 17 has a slot 19 therein. This slot has further L-shaped indents 20 extending from it. To adjust the length of the shaft, half shaft 16 is inserted into half shaft 17 with the projection 18 moving along slot 19. When the desired length of shaft is achieved, the projection 18 is aligned with an opening to an indent 20 and the two half shafts rotated relative to each other so that the projections move into the indent. The two half shafts are then pulled slightly apart so that the projection 18 may sit in the bottom of the L-shaped indent as shown in FIG. 7. It may also be desirable to provide a similar projection, slot and indent ensemble on the opposite side of the shaft.

In an alternative embodiment of the invention shown in FIG. 8, the blades 21,22 are mounted on the shaft portions 24 in the same manner as described above. In this case, however, there are three shaft positions, 23,24 and 25. Portions 23 and 24 are straight. Portion 25 is however, curved into a yoke-like shape to pass around the shoulders. The length of the shaft as a whole may be adjusted to having a projection slot and indent arrangement as described above with reference to FIGS. 7 and 8 between each of the shaft portions 23,24, and 25. In this case since the blade portions are "further forward" in use it is possible for the handles 26,27 to be mounted on the shaft co-axial with the shaft, although handles perpendicular to the shaft may be provided if preferred.

I claim:

1. A trunk-twist exercise device which consists of a shaft having blades mounted at either end thereof and two handles attached to said shaft, each handle being closer to the end of said shaft than its mid point and being mounted with its axis perpendicular to the axis of the shaft, wherein the angle between the axis of the handles and the plane of the blades is adjustable.

2. A trunk-twist exercise device as claimed in claim 1, wherein the shaft is of adjustable length.

3. A trunk-twist exercise device as claimed in claim 2, wherein adjustment of the length of the shaft is effected by forming the shaft of multiple portions, one portion being capable of insertion within the other or others to varying extents depending on the desired length of the shaft.

4. A trunk-twist exercise device as claimed in claim 1, where the blades are detachable.

5. A trunk-twist exercise device as claimed in claim 1 wherein the shaft is between 5 and to 7 feet.

6. A trunk-twist exercise device as claimed in claim 1, wherein the shaft has a central yoke-shaped curved section.

7. A trucnk-twist exercise device as claimed in claim 1 wherein the shaft is adjustable to a length of from 5 to 7 feet.

* * * * *